US007895708B2

(12) United States Patent
Proud et al.

(10) Patent No.: US 7,895,708 B2
(45) Date of Patent: Mar. 1, 2011

(54) HOSE ASSEMBLY FOR SUCTION CLEANER

(75) Inventors: Reuben Proud, Worcester (GB); Gavin Burnham, Birmingham (GB)

(73) Assignee: VAX Limited, Worcestershire (GB)

( * ) Notice: Subject to any disclaimer, the term of this patent is extended or adjusted under 35 U.S.C. 154(b) by 1029 days.

(21) Appl. No.: 11/187,414

(22) Filed: Jul. 22, 2005

(65) Prior Publication Data

US 2006/0016045 A1 Jan. 26, 2006

(30) Foreign Application Priority Data

Jul. 22, 2004 (GB) ..... 0416335.8

(51) Int. Cl.
*A47L 9/02* (2006.01)

(52) U.S. Cl. ..... 15/414

(58) Field of Classification Search ..... 15/414, 15/422.1, 300.1, 320, 321, 337, 410, 315, 15/322, 323; 138/129, 119; *A47L 9/24*
See application file for complete search history.

(56) References Cited

U.S. PATENT DOCUMENTS

| | | | | |
|---|---|---|---|---|
| 1,371,981 | A * | 3/1921 | Rose | 285/61 |
| 2,396,059 | A * | 3/1946 | Roberts | 138/122 |
| 2,867,833 | A * | 1/1959 | Duff | 15/323 |
| 3,879,797 | A * | 4/1975 | Principe et al. | 15/334 |
| 4,955,106 | A * | 9/1990 | Stein et al. | 15/335 |
| 5,078,761 | A | 1/1992 | Dyson | |
| 5,125,127 | A | 6/1992 | Bach et al. | |
| 5,135,552 | A | 8/1992 | Weistra | |
| 5,351,362 | A | 10/1994 | Kramer et al. | |
| 5,500,979 | A | 3/1996 | Wörwag | |
| 5,584,436 | A * | 12/1996 | Sepke | 239/154 |
| 5,797,162 | A * | 8/1998 | Vystrcil et al. | 15/323 |
| 5,960,514 | A | 10/1999 | Miller et al. | |
| 6,058,559 | A | 5/2000 | Yoshimi et al. | |
| 6,108,861 | A * | 8/2000 | Vystrcil et al. | 15/323 |
| 6,350,292 | B1 | 2/2002 | Lee et al. | |
| 6,572,668 | B1 | 6/2003 | An et al. | |
| 6,662,403 | B2 | 12/2003 | Oh | |
| 2002/0011053 | A1 | 1/2002 | Oh | |
| 2002/0062632 | A1 | 5/2002 | Oh | |
| 2002/0088078 | A1 | 7/2002 | Oh et al. | |

(Continued)

FOREIGN PATENT DOCUMENTS

| | | |
|---|---|---|
| DE | 38 34 686 C1 | 12/1989 |

(Continued)

OTHER PUBLICATIONS

Pending U.S. Appl. No. 11/217,584, filed Aug. 31, 2005, 17 pages.

(Continued)

*Primary Examiner* — Joseph J Hail, III
*Assistant Examiner* — Jamal Daniel
(74) *Attorney, Agent, or Firm* — Michael Best & Friedrich LLP

(57) ABSTRACT

A hose assembly for a suction cleaner, comprising a suction hose portion which is able to be extended lengthwise when subject to lengthwise tension and to return to a lengthwise-contracted configuration when relieved of the lengthwise tension, and a support means extending lengthwise of the hose portion and co-operable therewith to constrain at least part of it in its contracted configuration. There may also be a hose portion which is substantially non-extendible in normal use.

19 Claims, 4 Drawing Sheets

U.S. PATENT DOCUMENTS

| | | | |
|---|---|---|---|
| 2002/0120998 | A1 | 9/2002 | Dubos et al. |
| 2002/0124538 | A1 | 9/2002 | Oh et al. |
| 2003/0106182 | A1 | 6/2003 | Lee |
| 2003/0106183 | A1 | 6/2003 | Frederick et al. |

FOREIGN PATENT DOCUMENTS

| | | | |
|---|---|---|---|
| DE | 94 20 797.6 | U1 | 7/1995 |
| DE | 299 00 460 | U1 | 8/2000 |
| DE | 199 14 574 | C1 | 11/2000 |
| DE | 101 10 771 | A1 | 9/2002 |
| EP | 1 386 573 | A2 | 2/2004 |
| FR | 2 425 227 | | 12/1979 |
| GB | 2 128 075 | A | 4/1984 |
| GB | 2 367 510 | A | 4/2002 |
| WO | WO 98/35602 | A1 | 8/1998 |
| WO | WO 2004/049887 | | 6/2004 |
| WO | WO 2004/049890 | A1 | 6/2004 |
| WO | WO 2004/052166 | A1 | 6/2004 |
| WO | WO 2004096002 | A1 * | 11/2004 |

OTHER PUBLICATIONS

Pending U.S. Appl. No. 10/537,537, filed Nov. 14, 2005, 21 pages.
Pending U.S. Appl. No. 10/537,381, filed Nov. 14, 2005, 25 pages.
Pending U.S. Appl. No. 10/537,382, filed Nov. 14, 2005, 33 pages.
Pending U.S. Appl. No. 10/537,481, filed Nov. 14, 2005, 14 pages.
Pending U.S. Appl. No. 11/273,094, filed Nov. 14, 2005, 21 pages.
Pending U.S. Appl. No. 11/329,194, filed Jan. 10, 2006, 23 pages.
Pending U.S. Appl. No. 11/375,722, filed Mar. 15, 2006, 16 pages.

* cited by examiner

HOSE ASSEMBLY FOR SUCTION CLEANER

DESCRIPTION OF INVENTION

This invention relates to a hose assembly for a suction cleaner (vacuum cleaner), providing a connection between a suction unit and a wand, handle or cleaning tool of the cleaner.

The invention has been devised in relation to a suction cleaner of the so called "cylinder" type. This type of cleaner comprises a suction unit having a source of suction (a motor and impeller) and a separator/collector arrangement, for separating entrained dirt from the flow of air created by the source of the suction and for collecting and retaining such separated dirt for appropriate disposal. The separator/collector may include one or more filters for removing the dirt from the air flow and/or one or more "cyclonic" separators in which separation is effected by centrifugal force; the type of separator/collector is of no relevance to the present invention. In use, the suction unit is positioned in the vicinity of where a cleaning operation is being carried out and a flexible suction hose connects the suction unit to a cleaning tool being wielded by a person carrying out the cleaning. For floor cleaning and for cleaning some other surfaces, the cleaning tool usually is connected at the end of a elongate rigid wand, possibly telescopically extendible and contractible, whose other end is connected to the suction hose.

Apart from the cylinder type of suction cleaner, the other main type of cleaner is the "upright" type in which a floor cleaning head is provided as part of a generally upstanding suction unit, the whole cleaner being manoeuvrable over a floor surface by an operator. It is known that such a cleaner can have a suction hose either provided on the suction unit and able to be deployed for use with other cleaning tools, or possibly as a separate component, to be attached to the suction unit for use with cleaning tools other than the floor cleaning head. The present invention is also able to be used with the suction unit of an upright type of cleaner, if it has provision for use with a suction hose as above described.

Certain cleaning operations are facilitated if the hose of a suction cleaner is as long as possible. For example the cleaning of a stairway is conveniently carried out with the suction unit being positioned at the top or bottom of the stairway, in which case the hose needs to be long enough to enable an operator to clean a reasonable number of stairs therebetween. In most domestic situations, a hose at least four metres long, and possibly longer, is desirable.

The most robust and least expensive, and therefore most widely used, type of hose for suction cleaners is of plastics material and corrugated configuration. It is not intended to be extended lengthwise to any significant extent when it is subject to lengthwise tension, at least under the forces likely to be encountered in normal use. However, such a hose of sufficient length to make the cleaner versatile and easy to use in circumstances such as those described above is bulky and hence presents a storage problem, when the cleaner is not in use. Too long a hose can sometimes be inconvenient for other cleaning jobs, and be vulnerable to damage.

Suction hoses are known which are able to be extended when subject to lengthwise tension which revert to their original contracted length when no tension is applied. However when a cylinder type of cleaner is in use, the person using it typically drags the suction unit around by pulling on the hose, and this is difficult and impractical with an extendible hose.

Hence the provision of a hose of or capable of reaching a reasonable length, without introducing potential disadvantages, is a problem in relation to suction cleaners, and it is broadly the object of the present invention to address this problem.

According to one aspect of the present invention, we provide a hose assembly for a suction cleaner, comprising:

a suction hose portion which is able to be extended lengthwise when subject to lengthwise tension and to return to a lengthwise-contracted configuration when relieved of the lengthwise tension, and a support means extending lengthwise of the hose portion and co-operable therewith to constrain at least part of it in its contracted configuration.

The support means may be flexible, so that when the hose portion is in its contracted configuration and constrained by the support means it is still able to be bent reasonably freely, and thus used as a relatively short flexible suction hose if required.

Various configurations of the support means may be provided in accordance with the invention. In the embodiments described hereafter the support means is of plastics material and includes a wall portion extending along the hose portion adjacent one side thereof, and at least one formation extending circumferentially at least partially around parts of the hose portion.

Thus, when the hose portion is contracted, it is constrained by the support means in such a way as to occupy its minimum volume, and to be protected to some extent against sharp bending and the like which might cause damage. It can easily be used for pulling the suction unit of a cylinder cleaner around.

Alternatively the support means may be of generally tubular form to enclose at least part of the length of the hose portion when contracted. Possibly it could be of openwork form, comprising a lattice, mesh or the like.

The support means preferably has a length which corresponds to the length of the hose portion when it is in its contracted configuration.

The hose portion may have a connector at one end, for releasable connection to a suction unit of a suction cleaner, to a further hose portion, to a cleaning tool, or to a handle for connection to a wand or cleaning tool, and the support means may be connected to such a connector. A further connector may be provided at the other end of the hose portion, and the support means be releasably connected to such a further connector, to be releasable therefrom when the hose portion is to be extended.

The connectors may be of any appropriate type such as are well known for use in relation to hoses, wands, and cleaning tools of suction cleaners. For example bayonet type connectors may be utilised, or push-fit spigot and socket connectors, connectors incorporating retractable retaining lugs, clips, or the like.

A hose assembly in accordance with the invention may further comprise a suction hose portion which is substantially non-extendible in normal use.

In this case, the total length of hose available to be used is that of the non-extendible hose portion plus the maximum extended length of the extendible hose portion, the later being available for use when the extendible hose portion has been released from its constraint by the support means. When the extendible hose portion has been contracted and constrained by the support means, the overall length of the hose assembly is much less, so that less volume for its storage is required and the extendible hose portion is less vulnerable to damage when stored (or when it is in use but not in the extended configuration). When the extendible hose portion is contracted, an excess length of hose is less likely to cause a problem or hazard when cleaning operations are being performed which do not require the maximum hose length.

In the case of a hose assembly having extendible and non-extendible hose portions, the hose portion which is extendible may be adapted to be connected to a suction unit of a cleaner and the substantially non-extendible hose portion be connected or adapted to be connected to a handle for connection to a cleaning tool.

Alternatively the hose portion which is substantially non-extendible may be adapted to be connected to a suction unit, and hose portion which is extendible be connected to a handle for connection to a cleaning tool or wand.

In the later case, the support means may be connected to a connector at an end of the extendible hose portion, which provides a connection to the substantially non-extendible hose portion, whilst the support means may be releasably connected to the handle, to be released therefrom when the extendible hose portion is required to be extended.

As an alternative to the use of "external" support means for the extendible hose portion, in the case of a hose assembly wherein the extendible hose portion is connected to a handle for connection to a cleaning tool or wand, the support means may comprise a portion of or associated with the handle, forming a chamber within which at least part of the extendible hose portion can be accommodated when it is in its contracted configuration. Such a chamber may be of tubular form, of diameter such that the extendible hose portion can be entered therein when in its contracted configuration and deployed therefrom as required.

The end of the extendible hose portion where it is connected or connectable to the non-extendible hose portion may be provided with means by which it can be retained at an open end of the chamber whence it can be deployed. For example a connector between the extendible and non-extendible hose portions may have a formation engageable with the handle, e.g. by bayonet, clip, friction-retention, or other means.

The end of the extendible hose portion remote from the non-extendible hose portion may be moveable lengthwise within the chamber but arranged to be held captive at an open end of the chamber so as not to be removable therefrom, unless required.

These and other features of the invention will now be described by way of example with reference to the accompanying drawings.

DETAILED DESCRIPTION OF THE INVENTION

Figure 1:
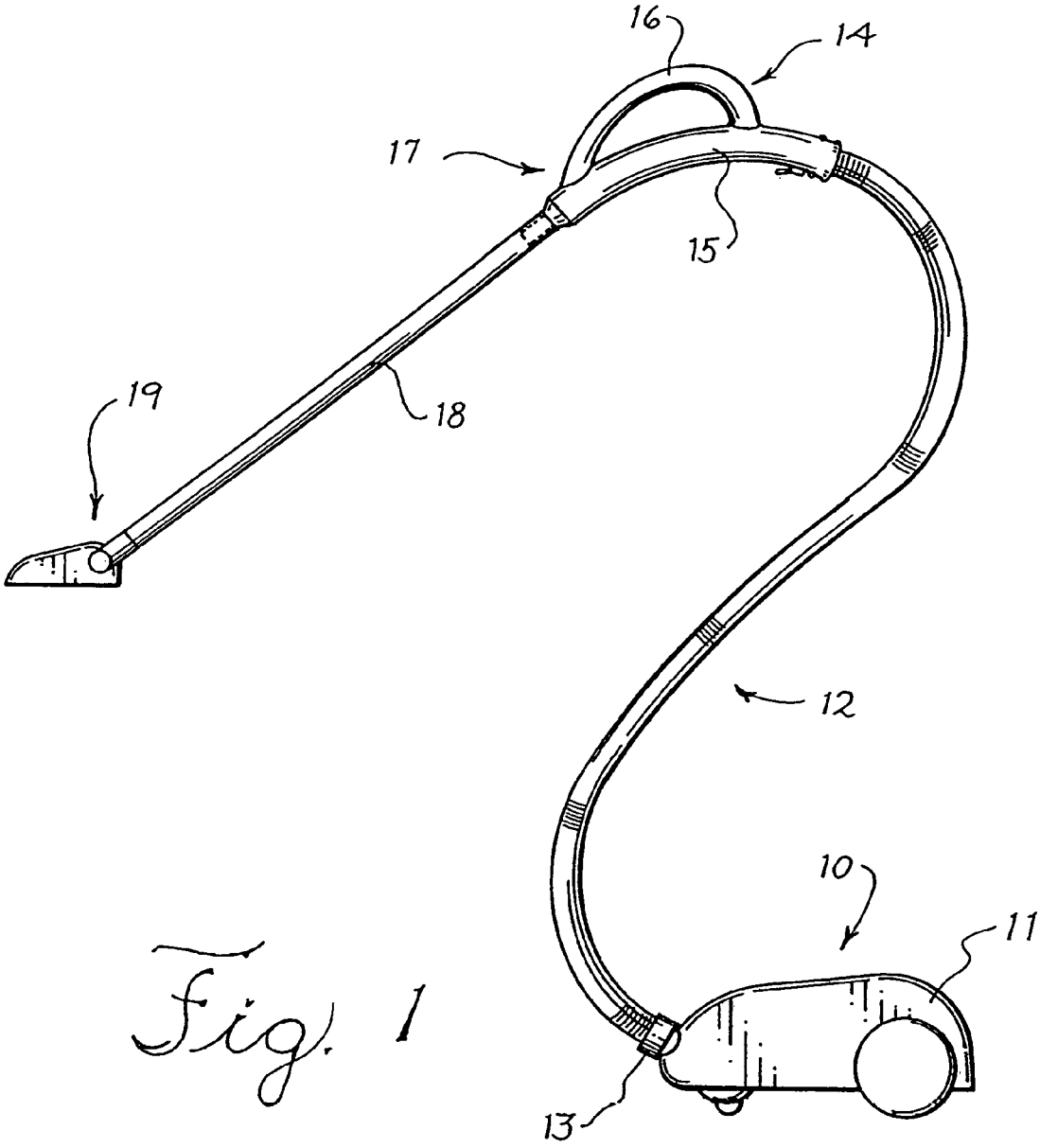
FIG. 1 is a diagramatic illustration of a hose assembly used with a cylinder type of vacuum cleaner.

Referring firstly to FIG. 1 of the drawings, this illustrates diagrammatically the suction unit 10 of a cylinder type of suction cleaner, having a body 11 within which is disposed a source of suction i.e. an electric motor and an impeller, and a separator/collector arrangement for separating dirt from the flow of air created by the source of suction and for collecting and retaining such separated dirt for appropriate disposal. A suction hose 12 is connected to an inlet on the body 11, one end of the hose 12 having a fitting 13 e.g. a bayonet fitting for detachable connection of the hose 12 to the inlet on the body 11. At the opposite end of the hose 12 to the end connected to the suction unit 10, the hose is connected to a handle 14 having a curved (or other form) tubular part 15 affording a passage for suction air flow from an inlet to the hose 12, and a manually-graspable part 16. For ease of use, the connections of the hose 12 to the fitting 13 and handle 14 will usually allow for swivelling of the hose relative to the handle and the fitting 13 or body 11, about the axis of the air flow passages established with these parts.

The handle 14 provides an inlet connection at 17 to a cleaning tool, e.g. an upholstery tool, crevice tool, dusting brush or the like, or, as shown in FIG. 1 to a wand 18 which may be in one or two parts and rigid or telescopically extendible. The connection 17 may be a push-on fit, or any other type of connection. A floor cleaning tool 19 is shown connected at the lower end of the wand 18, and the handle 14 and wand 18 enable a user to manoeuvre the head 19 over a floor surface being cleaned.

The hose 12 is typically of a plastics material and of corrugated configuration to enable it to be bent relatively easily as may be required in use. Whilst such a hose inevitably has some ability to extend under lengthwise tension, it is intended not to extend to any significant degree under normal loads encountered in use.

Figures 2, 3:
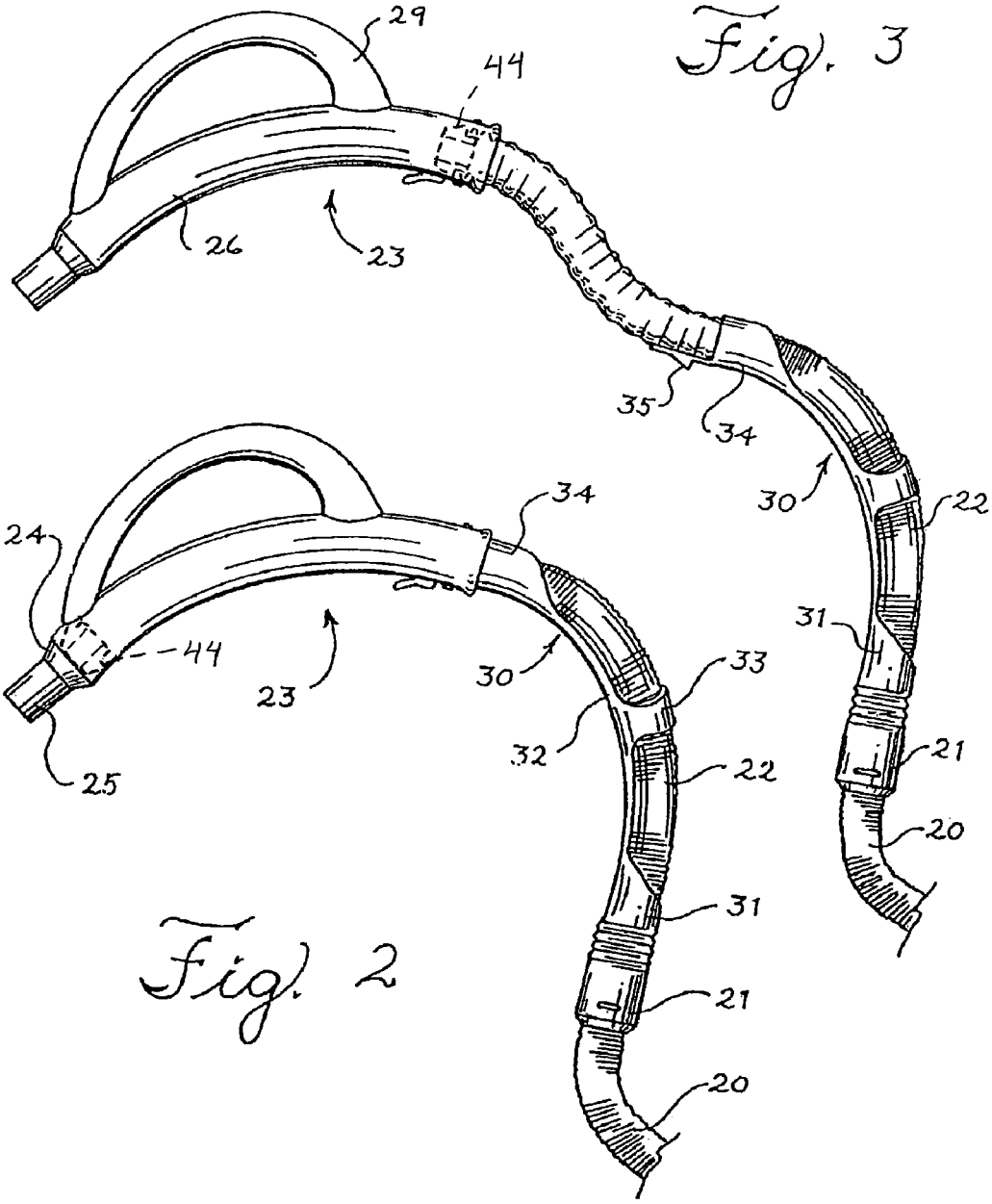
FIGS. 2 and 3 illustrate a first embodiment of hose assembly in accordance with the invention.

Referring now to FIG. 2 and FIG. 3, these show part of a hose assembly in accordance with the invention.

In these figures, a length of hose which preferably is substantially non-extendible and corresponds to the hose 12 shown in FIG. 1 is indicated at 20. A connection 21, which may be the same type of connection by which the hose 12 is connected to the tubular part 15 of handle 14, connects the hose portion 20 to a hose portion 22 which is extendible when subject to lengthwise tension. A typical construction of such hose incorporates a helical springy metal element within a relatively flexible tubular plastics covering, the springy characteristics of the metal element causing the hose to contract to its shortest length when it is not under lengthwise tension. The opposite end of the hose portion 22 is connected to a handle assembly 23.

The handle assembly 23 comprises a front portion 24 with an inlet spigot 25 for connection to a wand or cleaning tool. The spigot 25 may be tapered, for a push fit to the tool or wand, retained by friction therebetween. Rearwardly of the spigot 25, the handle 23 has a part 26 of tubular configuration, within which the end region of the hose portion 22 can lie, either in its contracted configuration as shown in FIG. 2, or extended as shown in FIG. 3. Above its part 26, the handle 23 has a manually-graspable part 29.

A support means indicated generally at 30 is provided for the extendible hose portion 22. This is a moulding of a flexible plastics material, e.g. polypropylene, whose length corresponds to the length of the second hose portion which lies outside the handle 23 when the hose portion is contracted. The support means 30 has an end 31 which embraces the second hose portion closely adjacent its connection 21 to the first hose portion 20, and which secures the support means to the second hose portion. The support means further comprises a wall portion 32 which extends alongside the second hose portion 22 and formations 33, 34 which extend circumferentially at least partially around corresponding parts of the extendible hose portion. These formations allow the hose portion to be extended and contracted through the formations. At the front of the formation 34, the support means 30 has a formation 35 by which it can be detachably connected to the handle 29, e.g. by means of a releasable clip.

When the extendible hose portion 22 is contracted to its shortest length and the support means 30 connected to the handle 23, the support means holds the extendible hose portion in its contracted configuration and protects it to some extent by preventing it from being bent too tightly or kinked. In this condition, the hose can be used up to the total of the length of the first hose portion 20 and the contracted length of the hose portion 22. If the handle is pulled to move the suction unit of the cleaner around, the support means transmits the pulling force to the hose portion 20, relieving the extendible hose portion 22 of tension forces. If a greater length of hose is required, the support means can be released from the handle 23, and, by pulling on the handle to subject the hose to lengthwise tension, the extendible hose portion can be extended up to its maximum extended length. In doing this, the extendible hose portion 22 pulls through the formations 33, 34 on the support means. When the greater length of hose is no longer required, the extendible hose portion can be allowed to contract until the support means can be reconnected to the handle 23.

Figures 4, 5:
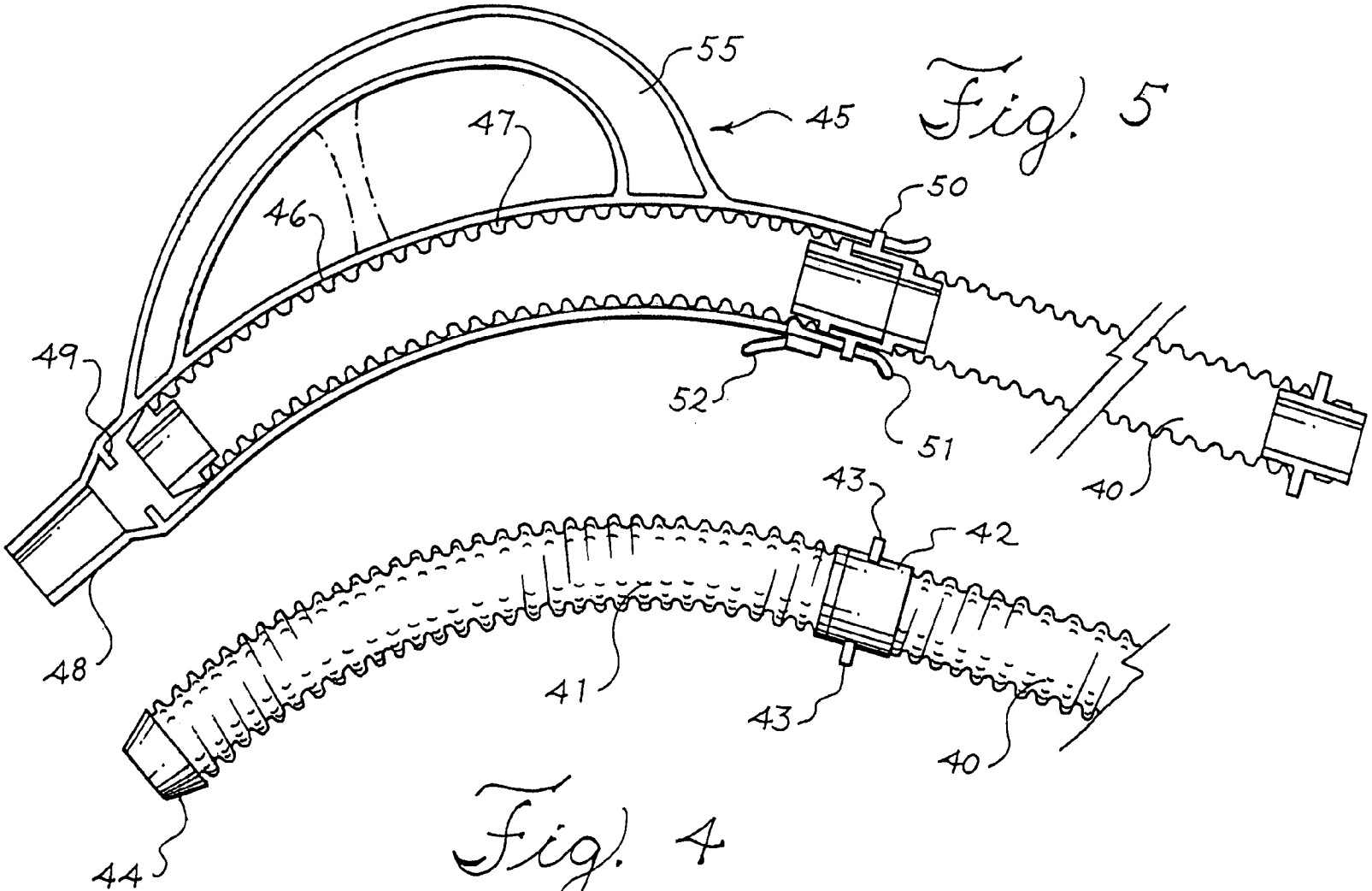
FIGS. 4 and 5 illustrate a second embodiment of hose assembly in accordance with the invention.

Referring now to FIGS. 4 and 5 of the drawings, these show an alternative arrangement of hose assembly in accordance with the invention. A first hose portion of substantially non-extendible hose is indicated at 40, and a second hose portion of extendible hose at 41. The hose portions are joined by a connector 42 which has outwardly extending lugs 43. The free end of the extendible hose portion 41 has a cuff 44.

A handle assembly is indicated generally at 45, and this comprises a body part 46 which is curved and of tubular configuration defining an internal tubular chamber 47 able to accommodate the second hose portion 41 when in its contracted configuration. At its front end, the body part 46 of the handle has a inlet spigot 48 for engagement with a wand or cleaning tool as above described and at the front end of the chamber 47 adjacent the spigot 48 there is an internal flange 49 with which the cuff 44 at the end of the hose portion 41 engages when the hose portion 41 is fully accommodated in the chamber 47. At the opposite, rear, end of the body part 46 of the handle the body has formations for bayonet type engagement by the lugs 43 on the connector 42, this engagement being shown at 50 in FIG. 5 of the drawings. Other types of engagement could be utilised instead of bayonet engagement. The free end of the body part 46 beyond the engaging formation is flared outwardly as indicated at 51, to provide a smooth surface for contact by the hose portion 41 when it is deployed for use as described hereafter. Also adjacent this end of the body part 46, there is a retaining clip 52 which is engageable with the cuff at the free end of the hose portion 41, to retain it within the body part 46, but which can be operated to disengage it from the cuff 44 to release the hose portion 41 completely from the handle assembly 45.

Above the body part 46, the handle assembly has a hand grip part 55 shaped for comfortable holding by a user.

In use of the hose assembly shown in FIGS. 4 and 5, when the connector 42 is engaged with the body part 46 and the handle assembly 45, as shown in FIG. 5, the length of hose available to be used is the length of the substantially non-extendible first hose portion 40. If a greater length of hose is required, the connector 42 can be disengaged from the handle assembly by a small angular movement and pulling, and then when the handle assembly is pulled further away from the hose portion 40 the extendible hose portion 41 is extended to deploy from the chamber 47. The cuff 44 at the end of the extendible hose portion 41 will slide rearwardly within the chamber 47 until it reaches the retaining clip 52 preventing further such movement. The length of hose available to be used is then the total of the length of the non-extendible hose portion 40 plus the extended length of the extendible hose portion 41. The flared end of the body part 47 of the handle assembly provides a smooth entry and exit of the extendible hose portion relative to the chamber 47, during its deployment and use. After use, the extendible hose portion 41 can be contracted and fed back into the chamber 47 until the connector 42 is able to be engaged with the body portion 46.

Possibly the extendible hose portion 41 could be provided with more than one cuff lying within the chamber when the hose portion is contracted. In addition to the cuff 44 at the free end of the hose portion, an intermediate cuff spaced between the ends of the hose portion could be provided. Then, the extendible hose portion could be extended and deployed in two stages from the chamber 47, to give the required additional length of hose.

Possibly not all the extendible hose portion need be able to be accommodated within the chamber 47 when contracted: a part of the hose portion may remain outside the chamber and a support means for such part may be provided. Such a support means may be detachable from the handle, analogously to the embodiment of FIGS. 2 and 3, or remain attached thereto. It may provide for holding a cleaning tool or tools for storage when not in use.

Extendible hoses are known which are able to extend to four or possibly even six times their contracted length, and longer extensions may be available in future. Thus a contracted length of, e.g., 30 cms of extendible hose, which is easily accommodated in a handle body portion 46 without making the latter inconveniently long, can provide nearly two metres of additional hose length available to the user when required.

Various types of hose fittings for connection to handles, wands or cleaning tools of suction cleaners, or to suction units thereof, are known in the art. Whilst we have referred above to bayonet-type fittings, and tapered push-fit connections to a wand or cleaning tool, it will be appreciated that other forms of such connection may be utilised whilst still retaining the main principle of the present invention.

Figures 6, 7:
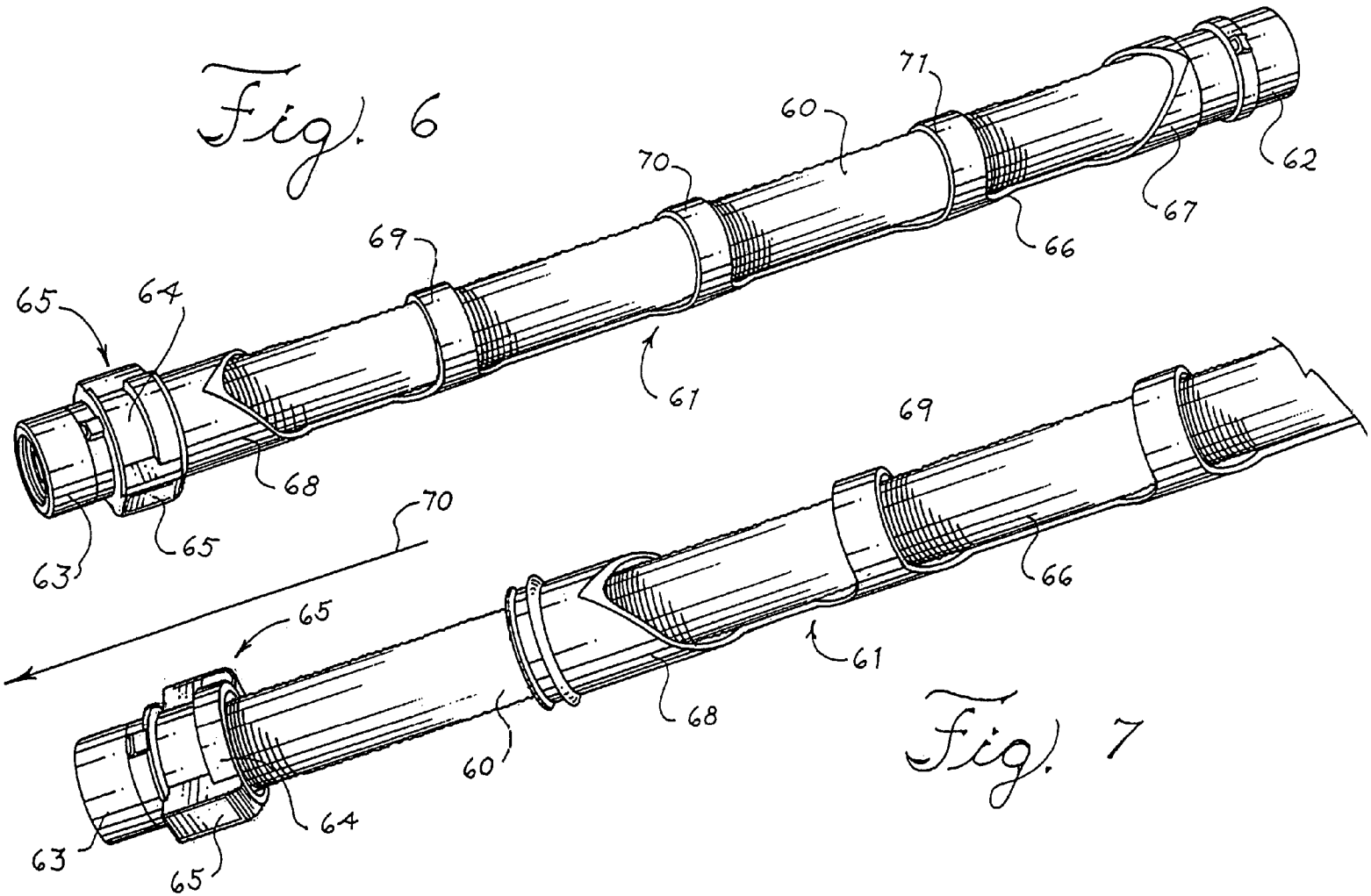
FIGS. 6 and 7 illustrate a further embodiment of a hose assembly in accordance with the invention.

Referring now to FIGS. 6 and 7 of the drawings, these show a further embodiment of hose assembly in accordance with the invention. This hose assembly may be used as the sole hose for a suction cleaner, or could possibly be used as the assembly of extendible hose portion 22 and support means 30 as illustrated in FIGS. 2 and 3 of the drawings.

FIGS. 6 and 7 show a hose portion 60 of extendible hose, and a support means therefor indicated generally at 61. The hose portion 60 is provided at one end with a connector cuff 62 enabling the hose to be connected to a suction unit, or to a handle, a further hose, a cleaning tool or a wand. At its other end, the hose portion 60 has a connector cuff 63 for sealing, preferably swivelable, connection to a suction unit, a handle, a further hose, a tool, or wand, as appropriate bearing in mind what the other end of the hose assembly will be connected to. The cuff 63 further has a receiving body part 64, extending towards the opposite end of the hose assembly and having two diametrically opposed retaining clips 65 for co-operation with the support means, as described hereafter.

The support means 61 comprises a wall portion 66 extending lengthwise of the hose 60 along one side thereof. At one end the wall portion 66 is connected to a formation 67 which extends around the hose 60 and forms part of or is attached to the connector cuff 62. At the opposite end of the support means the wall portion 66 ends in a formation 68 which extends around the hose 60 and is releasably connected to the body part 64 of the connector cuff 63, being retained thereto by the clips 65. Between its ends, the support means has three formations 69, 70, 71 which extends at least partially around the hose 60, so that the hose and support remain together over the length of the support means.

FIG. 6 shows the hose assembly with the extendible hose portion 60 in its fully-contracted condition, and the support means connected to the cuff 63, 64 as aforesaid. The hose assembly may be stored in this condition, or used for cleaning jobs if a relatively short length of hose is adequate. The hose is capable of being bent as required when in this condition, although it can be expected to have at least a tendency to return to the straight condition as illustrated. When a longer length of hose is required, the clips 65 can be released from the formation 68 at the end of the support means, and the extendible hose pulled out from the support means in the direction indicated by arrow 70 in FIG. 7.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A hose assembly for a suction cleaner, comprising a handle assembly including a tubular part having a first end and a second end, a suction hose portion that includes an extendible portion having an end, the extendible portion configured to be extended lengthwise when subject to lengthwise tension and to return to a lengthwise-contracted configuration when relieved of the lengthwise tension, and a flexible support means extending lengthwise of the extendible hose portion and co-operable therewith to constrain at least part of the hose portion in its contracted configuration when the support means is connected to the handle assembly and to allow extension when disconnected, a second hose portion disposed within the handle assembly, the second hose portion including a first end that is movable and positionable at a point adjacent each of the first end and the second end of the tubular part during suction cleaner use.

2. A hose assembly according to claim 1 wherein the support means includes at least one formation extending circumferentially at least partially around parts of the hose portion.

3. A hose assembly according to claim 1 wherein the support means includes a wall portion extending along the hose portion adjacent one side thereof.

4. A hose assembly according to claim 1 wherein the flexible support means has a length that corresponds to a length of the extendible hose portion when the extendible hose portion is in its contracted configuration.

5. A hose assembly according to claim 1 wherein the flexible support means is made from plastic.

6. A hose assembly according to claim 1, wherein the extendible hose portion has a first end and a second end, a connector at the second end for releasable connection to a second hose portion, a cleaning tool, or a handle, and the support means is connected to the connector.

7. A hose assembly according to claim 1 wherein the suction hose portion includes a substantially non-extendible portion.

8. A hose assembly according to claim 7 wherein the extendible hose portion is adapted to be connected to a suction unit and the non-extendible hose portion is adapted to be connected to a handle for connection to a cleaning tool or wand.

9. A hose assembly according to claim 7 wherein the non-extendible hose portion is adapted to be connected to a suction unit, and the extendible hose portion is connected to a handle for connection to a cleaning tool or wand.

10. A hose assembly according to claim 9 wherein the extendible hose portion further comprises a connector to which the flexible support means is connected to provide a connection to the non-extendible hose portion.

11. A hose assembly according to claim 10 wherein the flexible support means is connected to the handle and releasable therefrom when the extendible hose portion is extended.

12. A hose assembly according to claim 1 wherein the extendible hose portion is connected to a handle for connection to a component selected from the group consisting of a cleaning tool or a wand, and the flexible support means includes a chamber within which at least part of the extendible hose portion is accommodated when the extendible hose portion is in its contracted configuration.

13. A hose assembly according to claim 12 wherein said chamber is of tubular form.

14. A hose assembly according to claim 12, wherein the extendible hose portion is connected to a non-extendible hose portion and is provided with a means by which it can be retained at an open end of the chamber from which it can be deployed.

15. A hose assembly according to claim 14 further comprising a connector located between the extendible hose portion and the non-extendible hose portion, wherein the connector has a formation engageable with the handle.

16. A hose assembly according to claim 15 wherein said formation has bayonet engagement with the handle.

17. A hose assembly according to claim 12 further comprising a substantially non-extendible hose portion connected to the extendible hose portion, wherein the end of the extendible hose portion remote from the non-extendible hose portion is movable lengthwise within the chamber, and the extendible hose portion is arranged to be held captive at an open end of the chamber.

18. A hose assembly according to claim 17 wherein the end of the extendible hose portion is adapted to be completely released from the chamber.

19. The hose assembly according to claim 13 wherein the chamber has a diameter such that a first portion of the suction hose portion is adapted to be enclosed within the chamber when the extendable portion is contracted.

* * * * *